United States Patent [19]

Goto et al.

[11] 4,402,765

[45] Sep. 6, 1983

[54] METHOD AND APPARATUS FOR TREATING STEEL SHEET STRUCTURES

[75] Inventors: Issei Goto, Funabashi; Kuniaki Tanabe, Higashimurayama; Hiroshi Okita, Yokosuka, all of Japan

[73] Assignee: Nihon Parkerizing Co., Ltd., Japan

[21] Appl. No.: 340,102

[22] Filed: Jan. 18, 1982

[51] Int. Cl.[3] ..... C23F 7/10

[52] U.S. Cl. ..... 148/6.15 R; 118/423; 134/75; 134/76; 134/77; 148/6.15 Z

[58] Field of Search ..... 148/6.15 R, 6.15 Z, 148/6.16, 6.17; 134/75, 76, 77; 118/423

[56] References Cited

U.S. PATENT DOCUMENTS 3,839,988 10/1974 Duerr ..... 148/6.15 R X

FOREIGN PATENT DOCUMENTS 1395383 8/1973 United Kingdom .
1450836 3/1975 United Kingdom .
1434348 5/1976 United Kingdom ..... 118/423

*Primary Examiner*—Michael R. Lusignan
*Attorney, Agent, or Firm*—Ostrolenk, Faber, Gerb & Soffen

[57] ABSTRACT

In the phosphate immersion treatment of a steel sheet structure such as an automobile body, a method is provided wherein the bottom of a treatment tank is flat. An object to be treated such as an automobile body is submerged in the treatment solution. The object to be treated is inclined upward and downward at least once to remove oil, reaction cases, and air collected inside the object. An apparatus for performing phosphate immersion treatment of the object is also provided wherein the treatment solution is sprayed toward the feeding side of the treatment tank to cause small waves, so that formation of a border line mark on the surface of the object due to temporary interruption of the feeding operation may be prevented. An undulation is formed in a conveyor arranged above the treatment tank, or a pair of drop lifters which are individually operable are mounted to the conveyor, so that the object may be inclined upward and downward.

9 Claims, 6 Drawing Figures

METHOD AND APPARATUS FOR TREATING STEEL SHEET STRUCTURES

BACKGROUND OF THE INVENTION

I. Field of the Invention

The present invention relates to a method and an apparatus for treating steel plate structures, especially steel sheets of automobile bodies or the like.

II. Description of the Prior Art

Chemical conversion treatment with phosphate is generally performed to treat steel sheet structures such as automobile bodies. Typically known chemical conversion treatments with phosphate are then immersion method and the spray method. These methods have advantages and disadvantages. For treating objects which are manufactured on automatic manufacturing lines, such as automobile bodies, the spray method is widely adopted due to stable productivity and quality.

Recently, in snowy areas such as the North American and European countries, a deicing agent such as rock salt or a mixture of rock salt with sand is scattered over the surface of the road. Owing to this, the outer panels of the automobile body, wheel houses and sills, and the interior of the doors are significantly corroded by the salt components, and improvements in resistance to scab corrosion and perforation corrosion have been desired.

As for the outer panels of the automobile body, these resistances have been significantly improved by improving the composition of the phosphate treatment solution mainly to achieve a lower zinc content ($Zn/PO_4=1/12$ or less) and a suitable total paint film thickness. However, the treatment solution may not be directly sprayed on the inner panel of an automobile body of complicated sections. Even if the treatment solution is directly sprayed on the inner panel, satisfactory degreasing during the cleaning stage and satisfactory formation of the chemical conversion coating may not be accomplished although it is not clear whether this is attributable to short treatment time or an insufficient amount of the treatment solution.

With the immersion method, the treatment time is 300 seconds or longer in comparison to 90 to 150 seconds with the spray method. The weight per unit area of the conversion coating is also as high as 5 g/m$^2$ in contrast with 1.5 to 2.5 g/m$^2$. The adhesion of the paint film to a coating to be formed in the process to follow is also inferior.

In order to shorten the treatment time in the immersion method, to make the conversion coating weight only 2.0 to 3.5 g/m$^2$, and to obtain a phosphate chemical conversion coating with good adhesion to the paint film to be formed thereon, it is necessary to control well the composition of the phosphate treatment solution and the conditions for the immersion treatment. For example, it is shown in the literature that the characteristics of the zinc phosphate coating of excellent quality formed by the immersion treatment method are within the range shown in Table 1 below:

TABLE 1

| Characteristics of Zinc Phosphate Coating | |
|---|---|
| Item | Characteristic |
| Coating Weight | 2.5 to 3.8 g/m$^2$ |
| P/(P + H) | 0.9 to 1.0 |
| Crystal Size | 3.5 to 10$\mu$ |

TABLE 1-continued

| Characteristics of Zinc Phosphate Coating | |
|---|---|
| Item | Characteristic |
| Crystal Shape | Columnar or Granular |

(Note)

(1) P/(P + H): P represents phosphophyllite $Zn_2Fe(PO_4)_2.4H_2O$, and H represents hopeite $Zn_3(PO_4)_2.4H_2O$, which are included in the coating of zinc phosphate. The characteristic shown in Table 1 above represents the content ratio of phosphophyllite.

(2) Crystal size: represents the maximum length of the crystal.

(3) Crystal shape: the zinc phosphate coating formed by the spray method and the conventional immersion method has a pointed, needle-like crystal shape.

Even if the composition and the temperature of the treatment solution in the immersion treatment are controlled, the characteristics of the obtained coating vary depending upon the immersion conditions.

In the phosphate conversion coating treatment of a steel sheet structure by immersion, in order to form a good and uniform phosphate coating suitable as a substrate for electrodeposition painting, it is desirable to make flow previously a liquid layer at a given depth below the surface of solution in the vicinity of the part wherefrom the steel sheet structure enters a tank of conversion coating treatment solution until a flow velocity of 20 m/min, preferably 10 m/min, is attained and to maintain the passing time of a given point of the body of steel sheet structure at 15 sec. or less, preferably 10 sec. or less.

Even when the flow velocity of the liquid layer is 20 m/min or more and the passing time is 15 sec. or more, an even phosphate conversion coating is formed in the same way. The phosphate coating thus formed, however, is of low quality and unsuitable as a substrate for painting by electrodeposition, because in the characteristics of coating, the crystal size becomes more than 15$\mu$ and the crystal form, needlelike, and because further the ratio P/P+H becomes 0.8 or less.

Moreover, in the phosphate conversion coating treatment of a steel sheet structure, there tend to occur mainly in the inside surface of the steel sheet structure portions such as air and gases formed by chemical reactions are stagnant and slowly move. Therefore, the formation of phosphate coating in these portions is remarkably hindered by such a tendency, and the hindrance constitutes a factor to form rust and blue color (iron phosphate). Accordingly, the parts wherein the formation of conversion coating is insufficient clearly show a poor adhesion of paint film and low corrosion resistance after painting.

Therefore, in order to form an excellent phosphate conversion coating, it is necessary to make easy the dispersion and transfer of the gases produced by the chemical reactions away from the steel sheet structure.

In addition to this, in the chemical conversion treatment with phosphate, the sludge formed by the reaction settles on the horizontal part or the box section of the object to be treated, and is held in the pinholes between the crystals of the coating or is deposited on the surface thereof. Even if the treated object is sprayed in the rinsing step to follow, the sludge may not be removed with ease. This leads to defective electrodeposition which is to be performed later, and degrades the qualities of the paint film, such as the paint adhesion, water resistance, and blister resistance. In order to solve these problems, it is necessary to change the shape of the bottom of the treatment bath tank and to reduce the amount of sludge in the treatment bath.

SUMMARY OF THE INVENTION

The present invention has been made to solve the various problems of the prior art and has for its primary object to provide a method and an apparatus for immersion treatment of a steel sheet structure wherein the inner and outer surfaces of the steel sheet structure having a complex shape are brought into uniform contact with a treatment solution to form a coating of uniform thickness thereon.

It is another object of the present invention to provide a method and an apparatus for immersion treating a steel sheet structure wherein the sludge concentration of the treatment solution is adjusted to prevent attachment of the sludge to the conversion coating.

DESCRIPTION OF THE PREFERRED EMBODIMENTS

Figure 1:
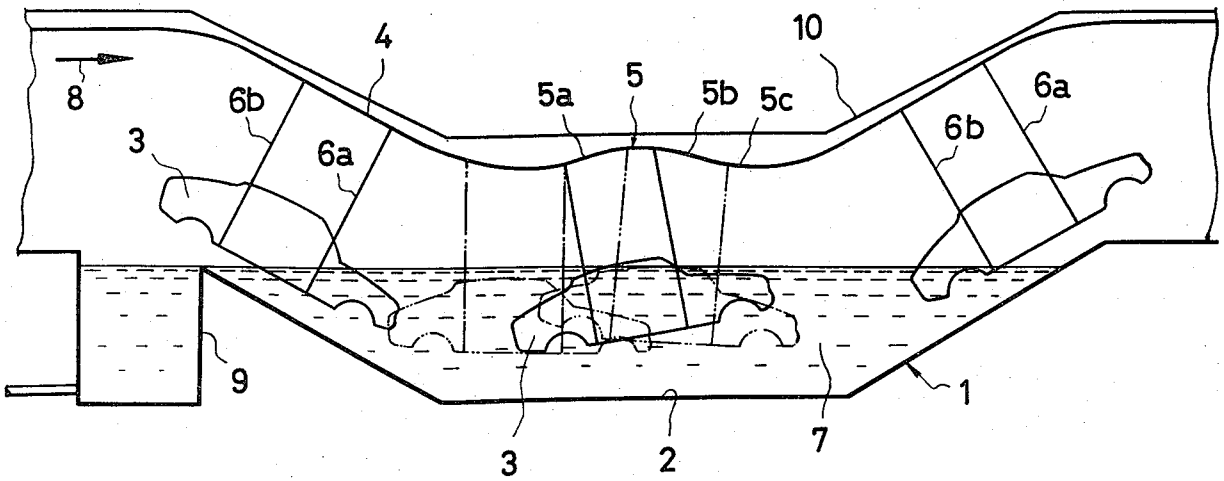
FIG. 1 is a schematic view showing the main part of an immersion treatment apparatus according to an embodiment of the present invention.

Referring to FIG. 1, reference numeral 1 denotes a treatment tank, the overall shape of which is substantially dish-like and a bottom surface 2 of which is flat. A steel plate structure to be treated in this tank 1 is an automobile body 3. The automobile body 3 is carried by a conveyor 4 to continuously pass through the interior of the tank 1. An undulation 5 is formed in the conveyor 4 so that the automobile body 3 is inclined upward and downward at substantially the center of the tank 1. This undulation 5 has an ascending part 5*a*, a descending part 5*b*, and an extended part 5*c*. The automobile body 3 is fed at a predetermined speed through a phosphate treatment solution 7 held in the tank 1 to be immersed completely therein for treatment while suspended by two suspension members 6*a* and 6*b* connected to the conveyor 4. The automobile body 3 is fed in the direction indicated by an arrow 8. Any solution treatment which overflows due to the submergence of the automobile body 3 flows to the outside through an overflow tank 9, or is recirculated. A ceiling 10 is formed for each booth above the conveyor 4 conforming to the shape thereof. Although only part of the chemical conversion treating apparatus is shown in FIG. 1, the apparatus includes before the immersion tank, in practice, spray-type and dip-type cleaning stages, a plurality of rinsing stages, and a dip-type surface treatment tank. The apparatus further includes, after the immersion tank, spray-type and dip-type rinsing stages, drying stages, and paint coating process connected thereto. Therefore, the series of operations of cleaning, rinsing, surface conditioning, and paint coating may be performed in a continuous manner.

In this embodiment, the steel sheet structure fed by the conveyor 4, that is, the automobile body 3, is inclined and submerged in the phosphate treatment solution. The angle of inclination of the automobile body 3 in this instance is preferably within the range of 20° to 30°. Although the automobile body is treated as submerged in the treatment solution, in the phosphate chemical conversion treatment, hydrogen gas and so on are generated by the reaction of the solution with the surface of the steel plate. In addition to this, air bubbles introduced together with the automobile body 3 are collected inside the top of the automobile body and cannot be exhausted. Where the gas or air bubbles collect, the surface of the automobile body may not be brought into contact with the treatment solution and may not be treated, resulting in nonuniform treatment. In order to solve this problem, as the suspension members 6*a* and 6*b* pass the undulation 5 after a predetermined period of time from the submergence of the automobile body 3 in the phosphate treatment solution, the automobile body 3 is inclined upward and downward. When the suspension parts 6*a* and 6*b* are at the ascending part 5*a*, the hydrogen gas and so on is exhausted from the front opening of the body. When the suspension parts 6*a* and 6*b* pass the descending part 5*b*, the hydrogen gas and so on is exhausted through the rear opening of the body, thereby completely exhausting the gases collected underneath the top of the body and accomplishing uniform contact of the treatment solution with the body. After this, when the suspension parts 6*a* and 6*b* pass the extended part 5*c*, the automobile body 3 is finally treated as submerged. The conveyor 4 feeds the automobile body 3 at a speed of 2 to 8 m/min, and the automobile body 3 is gradually taken out of the treatment tank 1.

Figure 2:
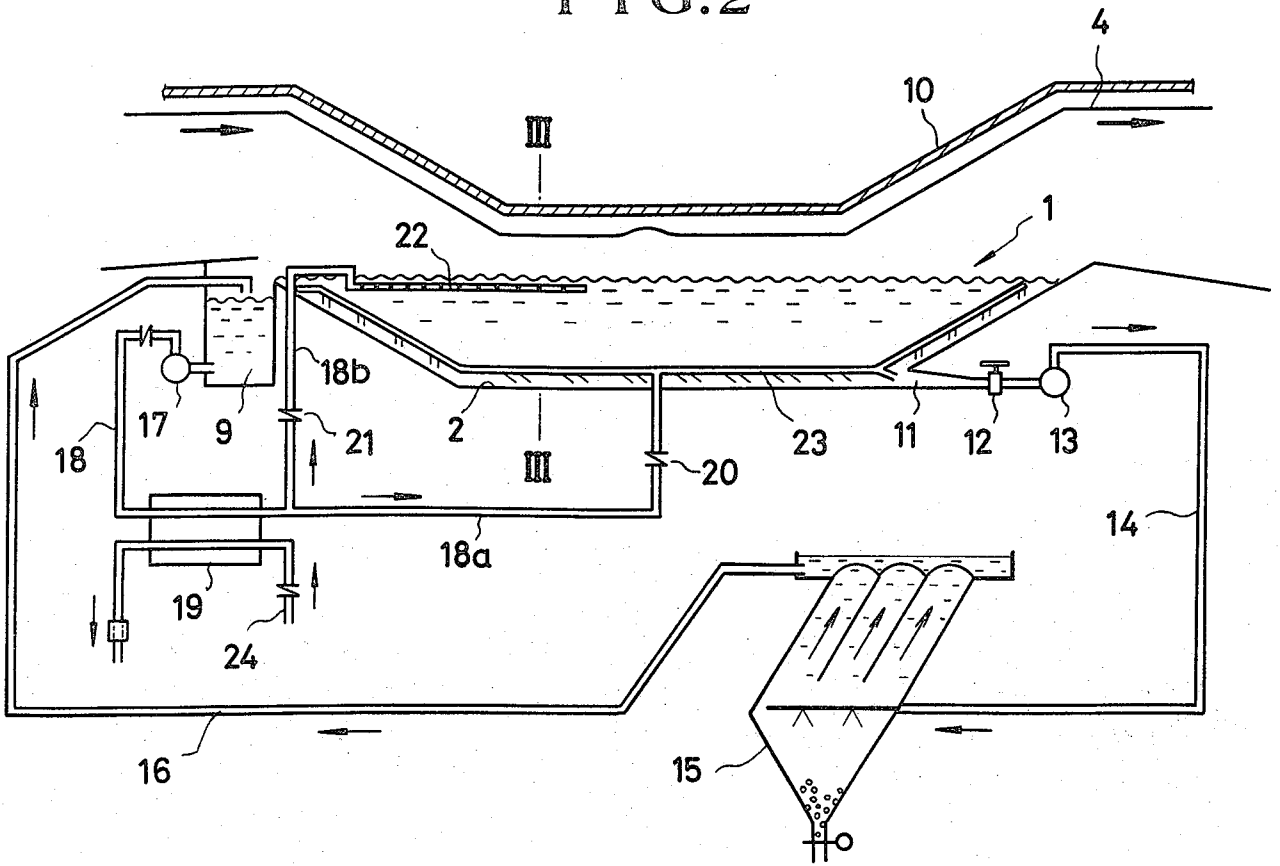
FIG. 2 is a schematic view showing the main part of an immersion treatment apparatus according to another embodiment of the present invention.
Figure 3:
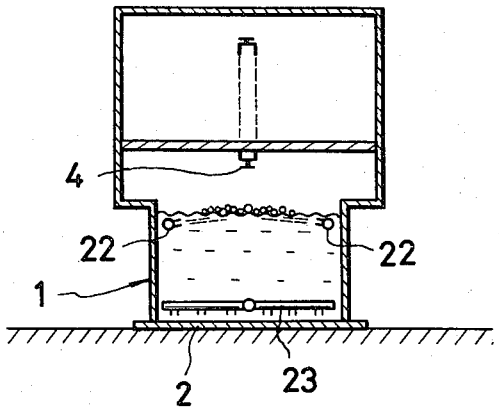
FIG. 3 is a sectional view along the line III—III of FIG. 2.

In the embodiment shown in FIG. 2, a circulating means of the treatment solution and a sludge removing means are added to the apparatus according to the embodiment shown in FIG. 1. An outlet port 11 for taking out the treatment solution is formed in the bottom of the treatment tank 1. A circulation pipe 14 having a valve 12 and a pump 13 is connected to this outlet port 11. A sludge removing device 15 communicates with the circulating pipe 14. The treatment solution from which the sludge is removed by this sludge removing device 15 flows to the overflow tank 9 through a feed pipe 16.

Another circulation pipe 18 is connected to the overflow tank 9 through a pump 17. The circulation pipe 18 is divided into two lines after a heat exchanger 19; one circulation pipe 18*a* is connected to the lower injection pipe 23 through a valve 20, and the other circulation pipe 18*b* extends to the feeding side of the treatment tank 1 for receiving the automobile body to be connected to the circulation pipe 18*b*, thus communication with an upper injection pipe 22 and the lower injection pipe 23 of the treatment tank 1.

The upper injection pipe 22 extends below the surface level of the treatment solution, and branches into nozzles arranged in the vicinity of the surface level. The treatment solution is sprayed or spouted from injection holes of the nozzles facing toward each other, thereby causing a predetermined flow of solution at the surface level and small waves. The lower injection pipe 23 extends along the bottom of the treatment tank 1 to spray the treatment solution downward so that settlement of the sludge at the bottom of the tank is prevented. In this manner, the sludge formed in the treatment tank 1 does not remain with the tank 1 but is carried out to the sludge removing device 15 together with the treatment solution through the outlet port 11 and the circulation pipe 14. At the sludge removing device 15, the sludge settles; the supernatant is transferred to the overflow tank 9. The treatment solution is then heated at the heat exchanger 19 to be supplied to the treatment tank 1 through the upper injection pipe 22 and the lower injection pipe 23. The heat exchanger 19 is one of known configuration generally used for heating liquids. A heating medium such as hot water is supplied to the heat exchanger 19 through a heat circulation pipe 24.

When feeding the automobile body 3 to be treated to the interior of the treatment tank 1 in this embodiment, the treatment solution is sprayed or spouted from the nozzles of the upper injection pipe 22. In this manner, the automobile body 3 is immersed in the treatment solution as a solution flow of predetermined speed and small waves are formed at the surface level of the treatment solution. When this measure is taken, even if there is an interruption of about 10 seconds during the feeding operation of the conveyor 4, the surface level of the treatment solution may not be marked on the surface of the object to be treated, that is, the automobile body 3. When immersing the automobile body in the treatment solution, the feeding speed of the conveyor 4 is about 2 to 8 m/min. The automobile body 3 is immersed in the treatment solution at a substantially same speed as the above and in a continuous manner, achieving continuous contact of the automobile body with the treatment solution. The reaction between the steel surface and the treatment solution progresses faster at the initial stage. Therefore, if there is an interruption in the feeding operation of the conveyor, the border line between the portion of the body that is immersed and the portion of the body that is not immersed, that is, the surface level, is marked distinctly on the surface of the body. However, since small waves are caused at the surface of the treatment solution in this embodiment, the border line is blurred. Furthermore, by spraying the treatment solution from the injection pipe 22, the local flow speed of the treatment solution at the feeding side of the tank is kept below 20 m/min, preferably below 10 m/min, so that a given point on the automobile body 3 may pass through the surface level in less than 15 seconds, preferably 10 seconds. When this is accomplished, nonuniform conversion coating treatment of the automobile body is prevented, and the thickness of the electrodeposited coating is made uniform. The chemical conversion reaction is suppressed at the initial stage during the continuous treatment of the object to be treated, since the quality of the finished automobile body largely depends upon the formation of the chemical conversion coating by the uniform crystal formation. The automobile body is inclined upward and downward at least once under a submerged condition to exhaust the gas which is collected underneath the top of the automobile body 3.

Figure 4:
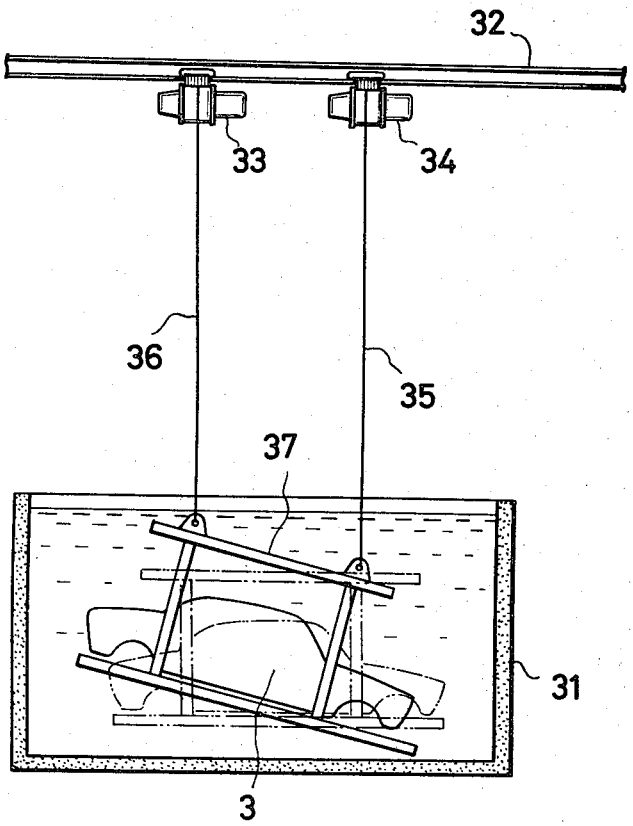
FIG. 4 is a schematic view showing the main part of a ducking-type treatment apparatus according to still another embodiment of the present invention.

In the embodiment shown in FIG. 4, a ducking-type treatment apparatus is used. A treatment tank 31 has a substantially rectangular cross section. A conveyor 32 for feeding the object to be treated, that is, the automobile body 3, is arranged above the treatment tank 31 as in the case of the embodiments described above. A pair of drop lifters 33 and 34 are mounted to the conveyor 32 at a predetermined interval. Suspension cables 35 and 36 are mounted to the drop lifters 33 and 34 in such a manner that the suspension cables 35 and 36 may be wound and rewound. A frame 37 is attached to the lower ends of the suspension cables 35 and 36. The automobile body 3 is placed on the frame 37. With this ducking-type treatment apparatus, as in the case of the former embodiments, before the treatment tank is included the cleaning and rinsing stages, and behind the tank are included the rinsing, drying, and paint coating process.

In this embodiment, after the automobile body 3 is submerged in the treatment solution, the drop lifters 33 and 34 are alternately wound and rewound to incline the automobile body 3 to exhaust the gas, oil and so on collected underneath the top of the automobile body, so that the inner surface thereof may be brought into uniform contact with the treatment solution. Therefore, even with a ducking-type treatment apparatus, by inclining the automobile body under the submerged condition, the inner surface of the automobile body may be uniformly treated.

In order to obtain the phosphate coating of the characteristics as shown in Table 1 above, the treatment solution is a zinc phosphate treatment solution of the composition:

| | | | |
|---|---|---|---|
| Zn | 0.5 | to | 2.0 g/l |
| Ni | 0 | to | 1.5 g/l |
| $NO_3$ | 3 | to | 25 g/l |
| $PO_4$ | 10 | to | 18 g/l |
| F | 0 | to | 1.3 g/l |
| $ClO_3$ | 0 | to | 2.0 g/l |
| $NO_2$ | 0.06 | to | 0.14 g/l |

The zinc phosphate treatment solution of this composition is neutralized by caustic soda (NaOH) or sodium carbonate ($Na_2CO_3$) so that the total acid of the treatment solution may become 15 to 20 points, and the acid ratio of the total acid to the free acid may become 12 to 26. The treatment temperature is set at 40° to 60° C. The tolerance of the treatment temperature is controlled to be ±3° C. Even with a treatment solution of the same composition, phosphate coatings of various characteristics are obtained depending upon the immersion conditions.

Figure 5:
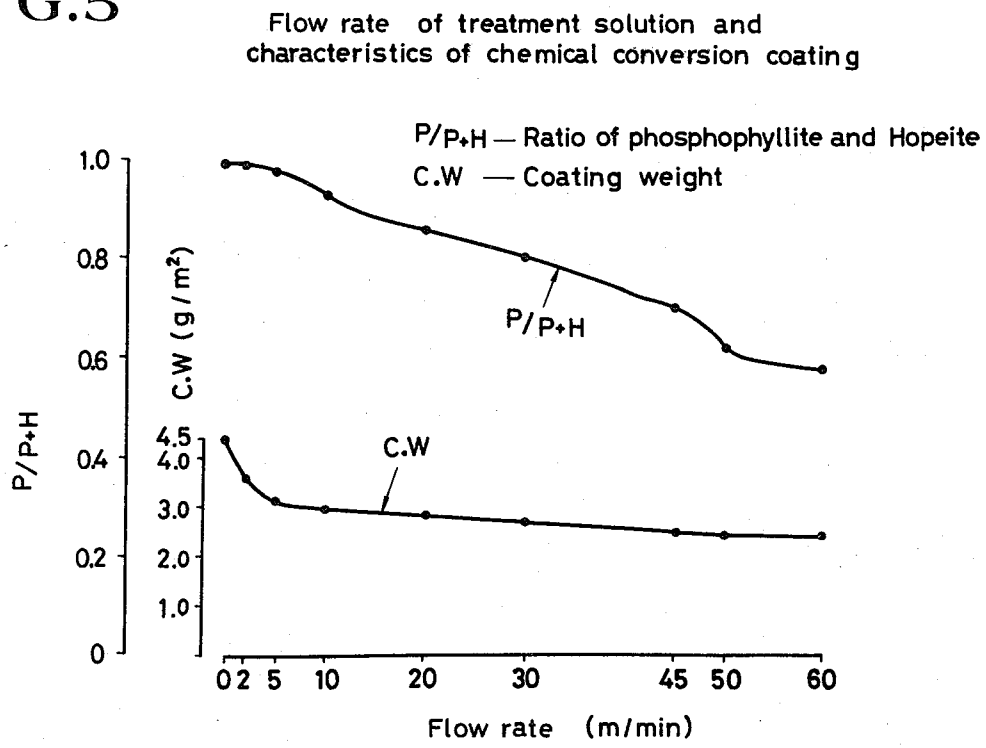
FIG. 5 is a graph showing the relationship between the characteristics of the chemical conversion coating formed on the surface of the object to be treated and the flow rate of the phosphate treatment solution.
Figure 6:
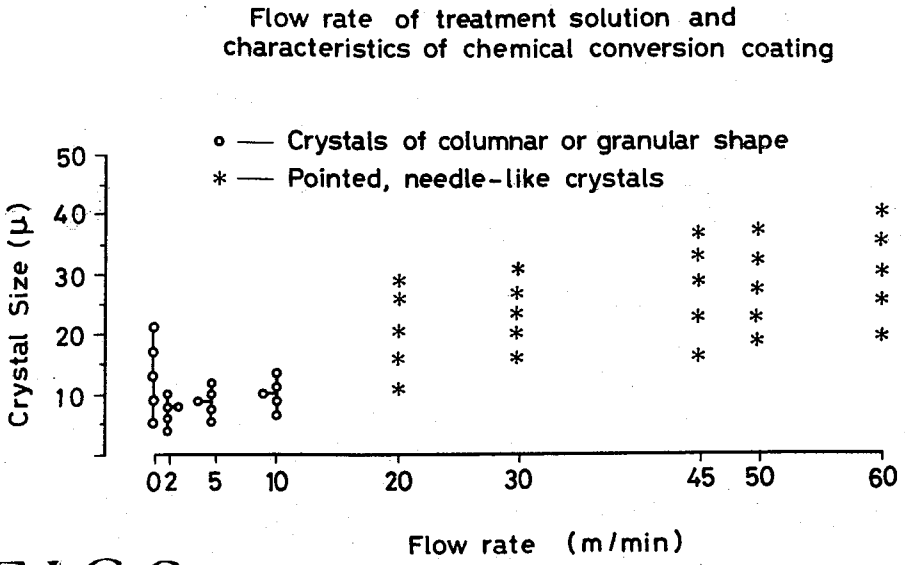
FIG. 6 is a graph showing the relationship between the characteristics (the crystal shape and the crystal size) of the chemical conversion coating and the flow rate of the phosphate treatment solution.

FIGS. 5 and 6 show the characteristics of the phosphate coating in relation to the treatment conditions. It is seen from these figures that the characteristics of the coating vary according to the speed of contact between the treatment solution and the surface of the object to be treated, that is, the automobile body. Although various reasons for this are conceivable, the greatest factor is considered to be the difference in the rate of increase in pH of the layer at the reaction interface. Especially in the treatment by the immersion method, a coating of excellent characteristics may be obtained by controlling the relative speed during contact between the object to be treated, i.e. the outer surfaces of the automobile bodies, and the treatment solution, to be within the range of 2 to 10 m/min, preferably 2 to 5 m/min. (Although the object to be treated is displaced in practice, this speed is represented as the flow speed of the solution in the figures, since only the relative speed between the two need be considered.) When the flow rate of the solution, i.e. the relative speed of the automobile body through the treatment solution and the flow of treatment solution, is 10 m/min or less, crystals of columnar or granular shape are obtained, which is preferable. When the relative speed of the solution exceeds 20 m/min, pointed, needle-like crystals are obtained, which does not provide a coating of preferable characteristics. In other words, when the relative speed of the solution exceeds 20 m/min, the crystal size as one characteristic of the coating becomes 15μ or more (see FIG. 6), and the ratio P/(P+H) becomes 0.8 or less (see FIG. 5), resulting in a coating of lower quality.

However, in the case of the immersion method wherein the automobile body is continuously fed into the treatment tank, even if there is an interruption of about 0.5 to 1 second during the feeding operation of the automobile body in the initial reaction stage, a border line of the solution level is formed on the surface of the automobile body and a nonuniform coating is formed. As a result, this nonuniform thickness results in irregular potential or other conditions of the surface of the automobile body during the subsequent electrodeposition. This further results in nonuniform deposition of the paint to be electrodeposited, and nonuniform coating of the paint. In order to prevent the nonuniform formation of the phosphate coating in the initial reaction stage, if the relative speed of the solution at the surface level is kept at about 20 m/min, the abrupt increase in pH at the reaction interface and the precipitation of the crystals are suppressed significantly due to the supply of fresh treatment solution at the reaction interface.

Therefore, even if the automobile body is fed noncontinuously, a border line is not marked on the surface of the automobile body, and a phosphate coating of uniform thickness is formed by the flowing effect of the treatment solution from the injection pipe.

With the immersion method as described above, the automobile bodies may be treated at a rate of 20 to 60 automobile bodies per hour. If the treating area per automobile body is assumed to be 80 $m^2$, the area of steel sheet treated is 1,600 to 4,800 $m^2$ per hour. In this case, the amount of sludge formed in the reaction is 3 to 4 g per square meter. Therefore, if the automobile bodies are treated at the rate of 20 automobile bodies per hour, 4.8 to 6.4 kg of sludge is formed. If the automobile bodies are treated at the rate of 60 automobile bodies per hour, 14.4 to 19.2 kg of sludge is formed. The sludge thus formed is fine and floats. As the time elapses, the sludge grows into particles of about 50 to 500μ size having a sedimentation rate of 0.08 to 0.13 m/min.

However, according to the present invention, the treatment solution is continuously taken out to remove the sludge at the sludge removing device. Therefore, the sludge is not settled on the bottom surface of the treatment tank. By making the bottom surface of the treatment tank flat, exhaustion of the sludge and uniform agitation of the treatment solution in the treatment tank may be facilitated, so that settlement or attachment of the sludge on the object to be treated is prevented.

In summary, according to the present invention, the immersion method is adopted in the phosphate chemical conversion treatment of the automobile body. Although oil and gas such as hydrogen is collected inside the automobile body, especially underneath the top of the automobile body, they are exhausted by inclining the automobile body upward and downward, so that the overall surface of the automobile body may be brought into uniform contact with the treatment solution. Accordingly, the problem of nonuniform treatment is solved, and treatment of the steel sheets with excellent resistance to scab corrosion and perforation corrosion may be performed.

What is claimed is:

1. In phosphate immersion treating of a steel sheet plate structure a method for immersion treating a surface of the steel sheet structure comprising the steps of: in a treatment solution held in a phosphate treatment tank, spraying the treatment solution below a surface level of the treatment solution toward a feeding side of the phosphate treatment tank to form small waves in the treatment solution and to cause a flow of treatment solution along the tank; submerging the structure completely in the treatment solution; relatively moving the treatment solution and the submerged structure along the tank so that the relative speed during contact between the surface of the structure and the treatment solution in the phosphate treatment tank is within a range of 2 to 10 m/min; and inclining the structure upward and downward at least once to exhaust oil, reaction gases and air collected inside the structure.

2. A method according to claim 1, wherein the relative speed of the treatment solution with respect to the structure submerged in the treatment tank is at a speed of 2 to 5 m/min in the phosphate treatment tank to make a distribution of reaction sludge in the treatment solution uniform, and continuously removing a fixed amount of the treatment solution outside the phosphate treatment tank and feeding it to a sludge removing device, removing the sludge in that device and returning a supernatant to the phosphate treatment tank.

3. A method according to claim 1, wherein the spraying of treatment solution comprises spraying two sprays of treatment solution generally toward each other from opposite sides of the tank for generating waves in the treatment solution.

4. In phosphate immersion treating of a steel sheet plate structure, a method for immersion treating a surface of the steel sheet structure comprising the steps of: in a treatment solution held in a phosphate treatment tank, spraying the treatment solution below a surface level of the treatment solution toward a feeding side of the phosphate treatment tank to form small waves in the treatment solution and to cause a flow of treatment solution along the tank; submerging the structure completely in the treatment solution; moving the submerged structure through the flow of treatment solution, and inclining the structure upward and downward at least once to exhaust oil, reaction gases and air collected inside the structure.

5. Apparatus for phosphate immersion treating a surface of a steel sheet structure comprising a phosphate treatment tank, a conveyor for feeding the structure, the conveyor being arranged above the phosphate treatment tank, undulation means included in the conveyor for inclining the structure selectively upward and downward to exhaust oil, reaction gases and air collected inside the structure, an injection pipe for spraying the treatment solution arranged at a side of the phosphate treatment tank and the spray is directed generally toward the opposite side of the tank for causing small waves and for causing a flow of treatment solution along the tank at a predetermined speed.

6. An apparatus according to claim 5, wherein there are two injection pipes each extending along a respective one of the opposite sides of the phosphate treatment tank, and each pipe including outlets for spraying the treatment solution toward the opposite side of the treatment tank, wherein the cooperating oppositely directed sprays cooperate for causing small waves in the flow of treatment solution.

7. An apparatus according to claim 5, wherein the tank has a bottom, an injection pipe for agitating the treatment solution arranged near the bottom of the phosphate treatment solution tank for causing the treatment solution in the phosphate treatment tank to flow at a predetermined speed along the tank and for preventing settlement of sludge on the bottom of the phosphate treatment tank.

8. An apparatus according to claim 5, wherein a circulation pipe is connected to the phosphate treatment tank to continuously take out the treatment solution from the phosphate treatment tank, a pump and a valve are connected to the circulation pipe for moving the treatment solution therethrough, and a sludge removing device for removing sludge from the solution and a heat exchanger for heating the treatment solution in the circulation pipe, are connected to the circulation pipe, the circulation pipe being connected to the injection pipe for delivering sludge cleaned treatment solution thereto.

9. An apparatus according to claim 5, wherein the conveyor conveys the structure at such speed along the tank and the injection pipe moves the treatment solution along the tank at such speed that the relative speed during contact between the surface of the structure and the treatment solution in the phosphate treatment tank is within a range of 2 to 10 m/min.

* * * * *